US008051810B2

(12) United States Patent
Hong

(10) Patent No.: US 8,051,810 B2
(45) Date of Patent: Nov. 8, 2011

(54) COOLANT PASSAGE WITHIN A CYLINDER HEAD OF AN INTERNAL COMBUSTION ENGINE

(75) Inventor: Soon Il Hong, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 433 days.

(21) Appl. No.: 12/275,054

(22) Filed: Nov. 20, 2008

(65) Prior Publication Data

US 2009/0260588 A1 Oct. 22, 2009

(30) Foreign Application Priority Data

Apr. 21, 2008 (KR) ..... 10-2008-0036804

(51) Int. Cl.
*F02F 1/36* (2006.01)
*F02F 1/40* (2006.01)
*F02F 1/42* (2006.01)

(52) U.S. Cl. ..... 123/41.82 R; 123/193.5

(58) Field of Classification Search ..... 123/41.82 R, 123/193.5

See application file for complete search history.

(56) References Cited

U.S. PATENT DOCUMENTS

| | | | | |
|---|---|---|---|---|
| 3,491,731 | A * | 1/1970 | Deutschmann et al. | 123/41.82 R |
| 4,889,079 | A * | 12/1989 | Takeda et al. | 123/41.82 R |
| 6,024,057 | A * | 2/2000 | Betchaku | 123/41.82 R |
| 6,470,865 | B2 * | 10/2002 | Iizuka et al. | 123/568.13 |
| 6,817,322 | B2 * | 11/2004 | Hardin | 123/41.82 R |
| 6,981,473 | B2 * | 1/2006 | Gunji et al. | 123/41.82 R |
| 7,086,355 | B2 * | 8/2006 | Yamamoto | 123/41.72 |
| 7,086,357 | B2 * | 8/2006 | MacVicar et al. | 123/41.82 R |

FOREIGN PATENT DOCUMENTS

| | | | |
|---|---|---|---|
| JP | 64-34423 | U | 3/1989 |
| KR | 10-2007-0038714 | A | 4/2007 |

* cited by examiner

*Primary Examiner* — Noah Kamen
*Assistant Examiner* — Grant Moubry
(74) *Attorney, Agent, or Firm* — Morgan, Lewis & Bockius LLP

(57) ABSTRACT

A cylinder head having a coolant passage therein includes a coolant inlet, an exhaust valve seat portion, intake valve seat portion, and a spark plug mounting portion formed centrally in the cylinder head, wherein a guide rib is formed close to the coolant inlet for coolant to flow near the spark plug mounting portion along the exhaust valve seat portion and a coolant outlet is disposed near to a corner of the intake valve seat portion.

7 Claims, 5 Drawing Sheets

COOLANT PASSAGE WITHIN A CYLINDER HEAD OF AN INTERNAL COMBUSTION ENGINE

CROSS-REFERENCE TO RELATED APPLICATION

The present application claims priority to Korean Patent Application No. 10-2008-0036804, filed on Apr. 21, 2008, the entire contents of which application is incorporated herein for all purposes by this reference.

BACKGROUND OF THE INVENTION

1. Field of the Invention

The present invention relates to a cylinder head. More particularly, the present invention relates to a cylinder head provided with a guide rib side of a coolant inlet and an eccentrically positioned coolant outlet for improving cooling efficiency.

2. Description of Related Art

Generally, a cylinder head of an engine provides a space for a valve system and is connected with a cylinder block for forming a combustion chamber and contributes to generation of driving torque of an engine.

In an explosion stroke of a combustion chamber, heat is generated and exhaust gas is subsequently discharged through an exhaust port of a cylinder head so that the cylinder head is exposed to heat.

If the cylinder head is not efficiently cooled, many elements such as a valve seat portion, a valve guide, a valve, and so on are subject to thermal damage by the heat, and an engine performance may be deteriorated.

Thus, a coolant passage is formed to a cylinder head, and suitable design of the coolant passage for cooling is one of the most important factors with respect to the performance and durability of an engine.

In a general cylinder head 100 of an engine, as shown in FIG. 4 and FIG. 5, coolant passage 101 is formed for coolant to flow around a spark plug mounting portion 103, intake and exhaust ports 105 and 107, and intake and exhaust valve seat portions 109 and 111 in order to cool them.

That is, coolant inlets 113 for the coolant to inflow are formed to sides of the exhaust valve seat portion 111 and coolant outlets 115 for the coolant to flow out are formed to sides of the intake valve seat portion 109.

Thus, the coolant inflows through the coolant inlet 113 to the coolant passage 101, flows around the exhaust valve seat portions 111 or between the exhaust valve seat portions 111, cools around the spark plug mounting portion 103, flows between the intake valve seat portions 109, and flows out through the coolant outlet 115.

In a general cylinder head 100, however, flowing of the coolant may be obstructed and reduced due to collision of the coolant so that cooling efficiency between the exhaust valve seat portions 111 and near the spark plug mounting portion 103 can be deteriorated.

Poor cooling efficiency between the exhaust valve seat portions 111 and near the spark plug mounting portions 103 may result in increasing abrasion of the exhaust valve seat portion 111.

Also, as shown in FIG. 4, in a case of a GDI engine, an injector mounting portion 117 is formed between the coolant outlets 115 of the cylinder head, and the coolant flows near the spark plug mounting portion 103 and flows out directly through the coolant outlets 115 so that cooling around the injector mounting portion 117 is poor.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a cylinder head having advantages of improving cooling efficiency near an exhaust valve seat portion and a spark plug mounting portion.

In an aspect of the present invention, a cylinder head having a coolant passage therein may include a coolant inlet, an exhaust valve seat portion disposed near the coolant inlet, a spark plug mounting portion disposed near the exhaust valve seat portion and formed substantially in a center portion of the cylinder head in a longitudinal direction thereof, and/or a guide rib protruding from an inner circumference of the cylinder head and configured to be close to the exhaust valve seat portion for coolant to flow near the exhaust valve seat portion and the spark plug mounting portion.

The guide rib may be disposed near a distal end portion of the coolant inlet.

The guide rib may be disposed between a center line connecting the exhaust valve seat portions and the inner circumference of the cylinder head.

A plurality of the guide ribs may be formed symmetrically with respect a line perpendicular to the center line connecting the centers of the exhaust valve seat portions.

The guide rib may have a triangle-shaped cross-section.

The guide rib may have a semi-circular cross-section.

The cylinder head may further include an intake valve seat portion disposed opposite the exhaust valve seat portion with respect to the spark plug mounting portion.

A coolant outlet may be disposed between a center line of the intake valve seat portions and inner circumference of the cylinder head, wherein the coolant outlet may be offset with a predetermined distance with respect to a line perpendicular to the center line connecting the centers of the intake valve seat portions.

An injector mounting portion may be formed adjacent to the intake valve seat portion.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
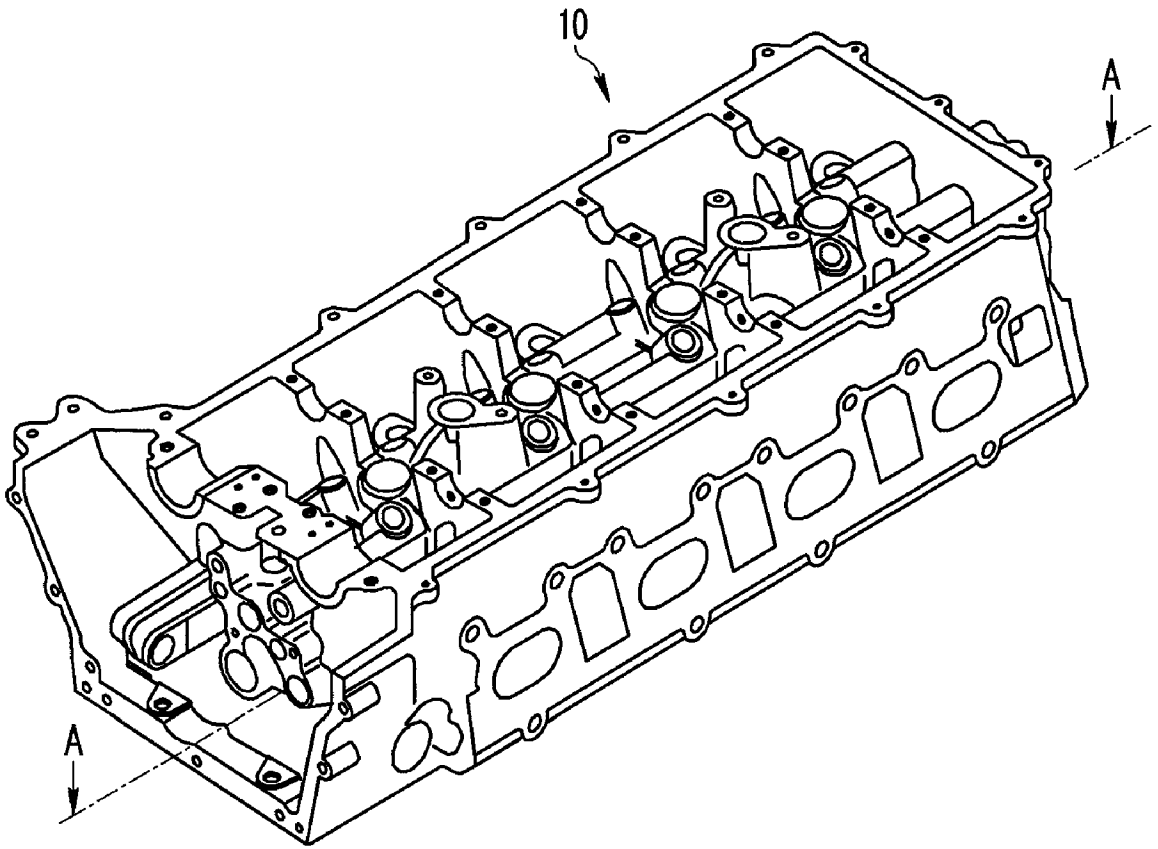
FIG. 1 is a perspective view of an exemplary cylinder head according to the present invention.
Figure 2:
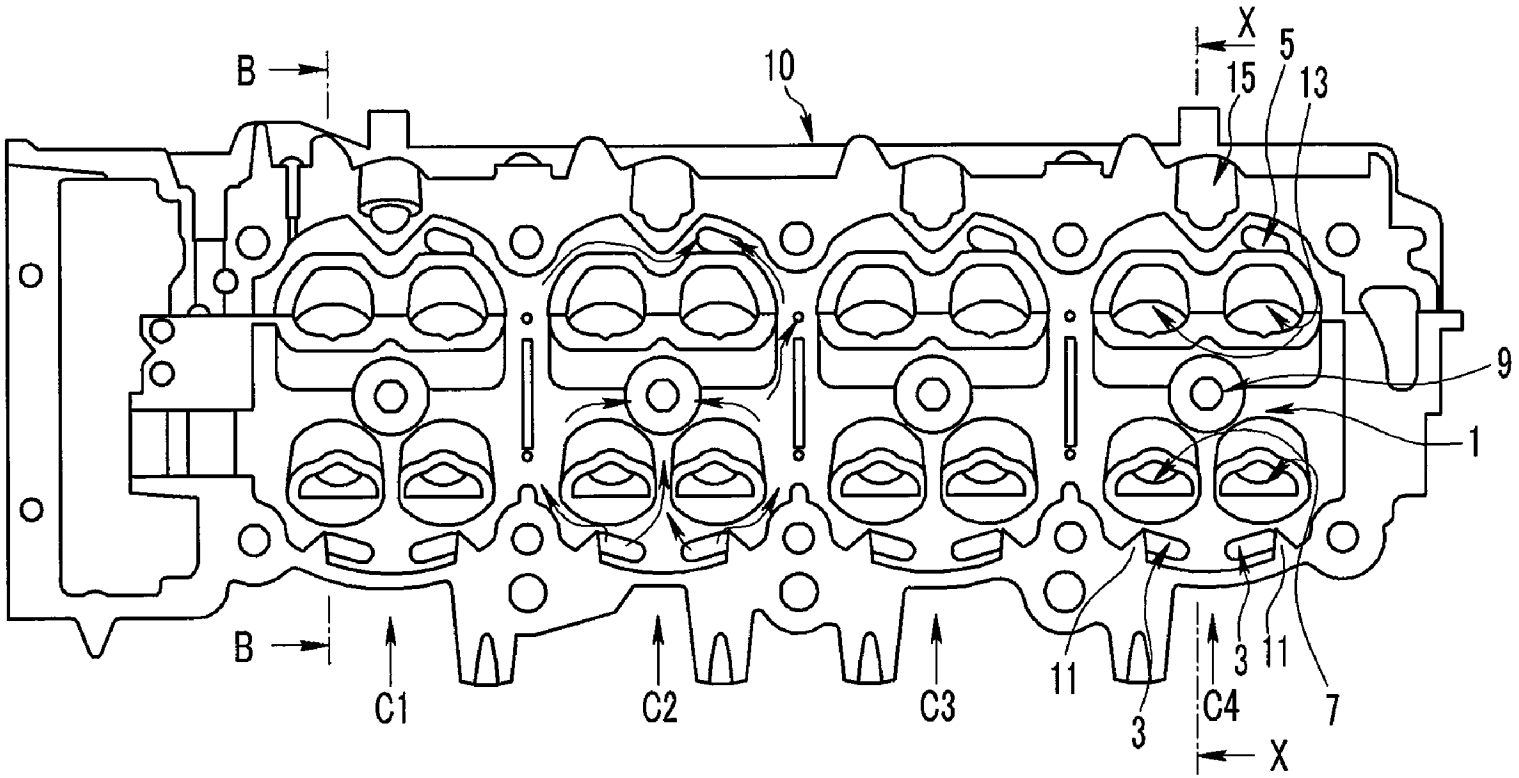
FIG. 2 is a cross-sectional view along a line A-A in FIG. 1.
Figure 3:
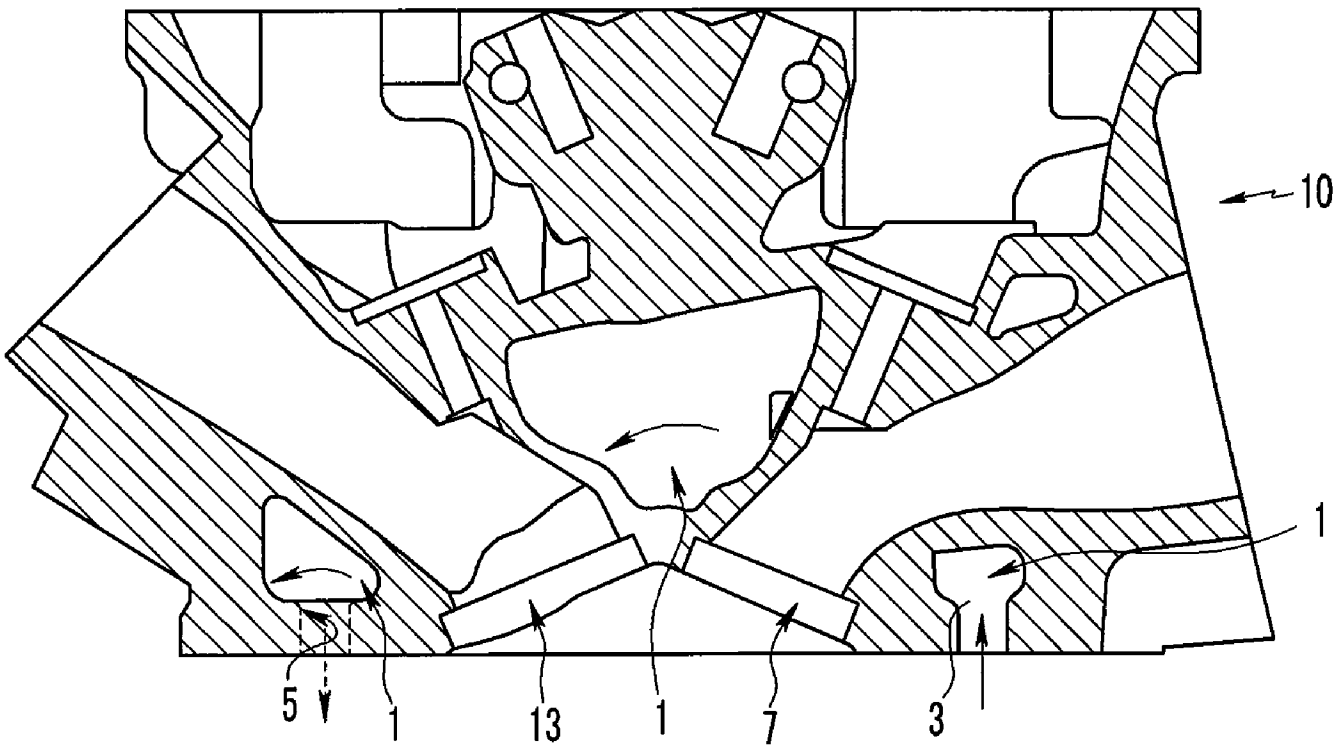
FIG. 3 is a cross-sectional view along a line B-B in FIG. 2.
Figure 4:
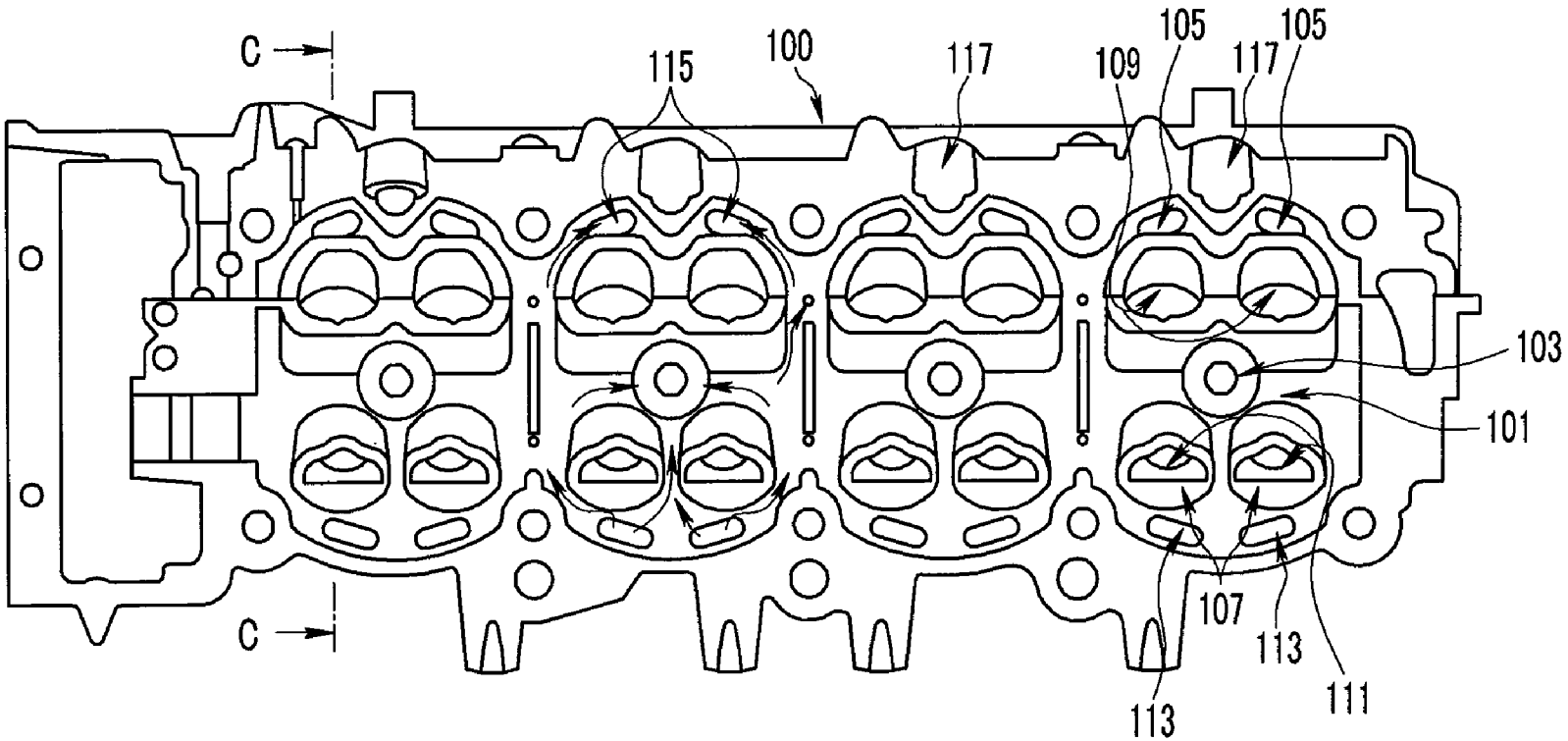
FIG.4 Prior Art
FIG. 4 is a cross-sectional view of a conventional cylinder head.
Figure 5:
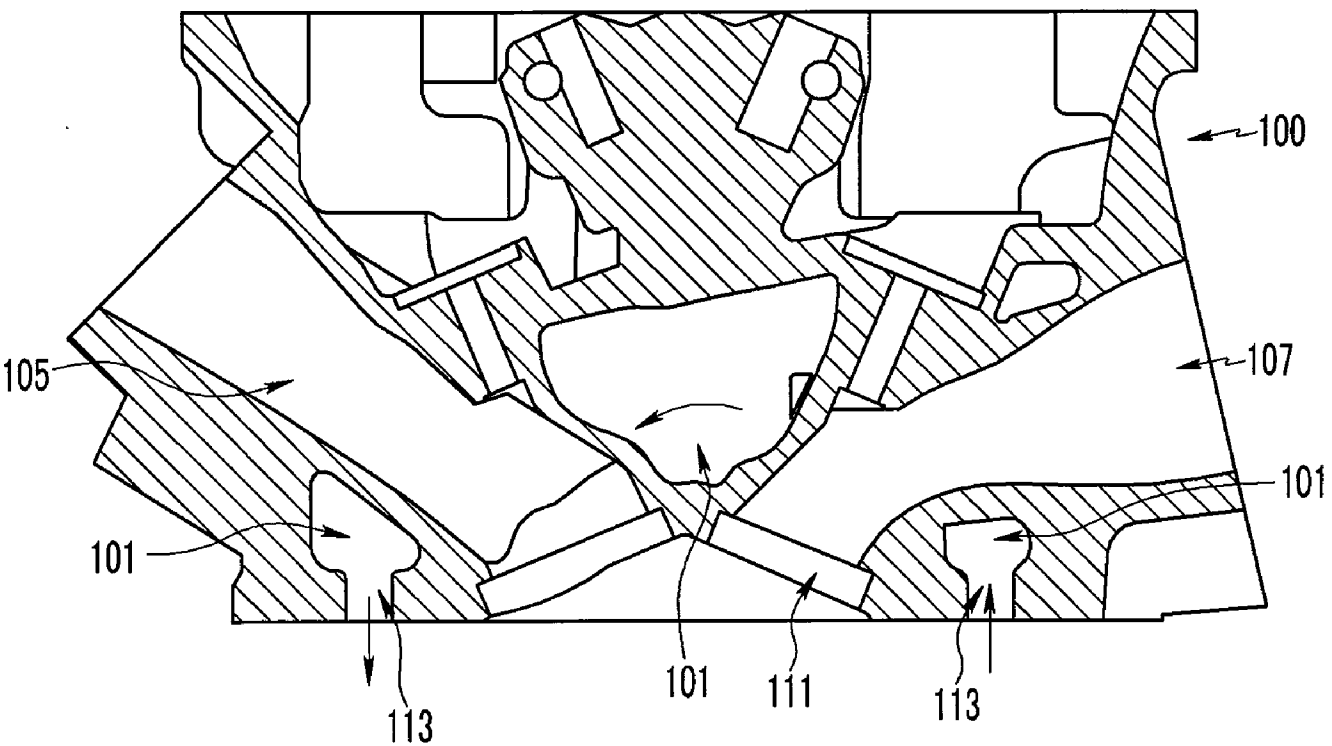
FIG.5 Prior Art
FIG. 5 is cross-sectional view along a line C-C in FIG. 4.

FIG. 1 is a perspective view of a cylinder head according to various embodiments of the present invention, FIG. 2 is a cross-sectional view along a line A-A in FIG. 1, and FIG. 3 is a cross-sectional view along a line B-B in FIG. 2.

As shown in FIG. 2, according to various embodiments of the present invention, a coolant passage 1 is formed inside a cylinder head 10.

As shown in FIG. 2 and FIG. 3, coolant for cooling the cylinder head 10 is supplied to the coolant passage 1 through a coolant inlet 3, flows along arrows in the drawing, and flows out through a coolant outlet 5.

Hereinafter, cylinders are indicated as first, second, third, and fourth cylinders C1, C2, C3, and C4 sequentially from the left side in FIG. 2, for convenience.

In the drawings, a straight four cylinder engine according to various embodiments of the present invention is described. However, it should be understood that the present invention is not limited thereto. The cylinder head according to various embodiments of the present invention can be used for other types of multi-cylinder inline engines, such as a "V" type engine, an opposed engine, and so on.

Also, in the drawings, a four valve engine provided with two intake valves and exhaust valves per cylinder is described. However, it should be understood that the present invention is not limited thereto.

A cylinder head 10 according to various embodiments of the present invention includes a coolant inlet 3, an exhaust valve seat portion 7 and a spark plug mounting portion 9 formed centrally in the cylinder head 10 in longitudinal direction of the cylinder head, wherein a guide rib 11 is formed close to the coolant inlet 3 for coolant to flow near the spark plug mounting portion 9 along and around the exhaust valve seat portion 7.

It is preferable that two exhaust valve seat portions 7 are formed and the guide rib 11 is symmetrically formed with respect to the coolant inlet 3 for the coolant to flow between the exhaust valve seat portions 7 to the spark plug mounting portion 9. The guide rib 11 is formed around the exhaust valve seat portions 7 so that the coolant can efficiently flow and cool near the exhaust valve seat portions 7 and the spark plug mounting portion 9.

It is preferable that the guide rib 11 has a triangle-shaped cross-section so that the guide rib 11 protrudes from the inside circumference of the cylinder head 10 towards the exhaust valve seat portion 7, but is not limited thereto. One will appreciate other shapes to form the guide ribs, such as semi-circular shape in various embodiments.

It is preferable that the guide rib 11 is disposed symmetrically with respect to a center line X toward the exhaust valve seat portion 7 for balancing flow of the coolant.

The coolant that has flown around the exhaust valve seat portion 7 and the spark plug mounting portion 9 flows around the intake valve seat portion 13 and then flows out through the coolant outlet 5.

In the drawing, the coolant outlet 5 is formed eccentrically from the center line X so that the coolant flows around an injector mounting portion 15, which is formed along the center line X and then flows out.

Due to this configuration, the coolant remains in the coolant passages around the injector mounting portion 15 longer than the conventional art. Thus, the coolant cools near the injector mounting portion 15 efficiently due to one eccentrically disposed coolant outlet 5.

According to various embodiments of the present invention, a cylinder head provided with a guide rib may improve cooling efficiency near an exhaust valve seat portion and a spark plug mounting portion.

Also, a coolant outlet is eccentrically positioned so that cooling efficiency near an injector mounting portion may be further improved.

For convenience in explanation and accurate definition in the appended claims, the term "inside" is used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cylinder head having a coolant passage therein, comprising:

a coolant inlet;

a plurality of exhaust valve seat portions disposed near the coolant inlet;

a spark plug mounting portion disposed near the exhaust valve seat portions and formed substantially in a center portion of the cylinder head in a longitudinal direction thereof;

a guide rib protruding from an inner circumference of the cylinder head and configured to be close to the exhaust valve seat portions for coolant to flow near the exhaust valve seat portions and the spark plug mounting portion, and a plurality of intake valve seat portions disposed opposite the exhaust valve seat portions with respect to the spark plug mounting portion;

wherein the guide rib is disposed near an end of the coolant inlet and extends toward the spark plug mounting portion;

wherein the guide rib is disposed between a center line connecting the exhaust valve seat portions and the inner circumference of the cylinder head; and wherein a coolant outlet is disposed between a center line of the intake valve seat portions and inner circumference of the cylinder head.

2. The cylinder head of claim 1, wherein a plurality of the guide ribs are formed symmetrically with respect a line perpendicular to the center line connecting the centers of the plurality of exhaust valve seat portions.

3. The cylinder head of claim 1, wherein the guide rib has a triangle-shaped cross-section.

4. The cylinder head of claim 1, wherein the coolant outlet is offset with a predetermined distance with respect to a line perpendicular to the center line connecting the centers of the plurality of intake valve seat portions.

5. The cylinder head of claim 1, wherein an injector mounting portion is formed adjacent to the intake valve seat portions.

6. An engine comprising the cylinder head of claim 1.

7. A passenger vehicle comprising the engine of claim 6.

* * * * *